US007972250B2

(12) United States Patent
Viselman

(10) Patent No.: US 7,972,250 B2
(45) Date of Patent: Jul. 5, 2011

(54) EXERCISE TRAINING TOOL

(76) Inventor: Kenn Viselman, West Hollywood, CA (US)

( * ) Notice: Subject to any disclaimer, the term of this patent is extended or adjusted under 35 U.S.C. 154(b) by 0 days.

(21) Appl. No.: 12/562,910

(22) Filed: Sep. 18, 2009

(65) Prior Publication Data

US 2010/0069206 A1 Mar. 18, 2010

Related U.S. Application Data

(60) Provisional application No. 61/098,192, filed on Sep. 18, 2008, provisional application No. 61/098,330, filed on Sep. 19, 2008.

(51) Int. Cl.
*A63B 21/06* (2006.01)
*A63B 22/16* (2006.01)

(52) U.S. Cl. ..... 482/93; 482/141

(58) Field of Classification Search ..... 482/44, 482/49, 88, 92–94, 106–110, 139–141, 148, 482/906; 473/422, 437, 441, 444, 596, 587; 273/DIG. 20; D21/662, 680–682; 472/114, 472/102

See application file for complete search history.

(56) References Cited

U.S. PATENT DOCUMENTS

| | | | | |
|---|---|---|---|---|
| 4,673,179 | A * | 6/1987 | Pengler | 482/148 |
| 5,910,074 | A * | 6/1999 | Purdie | 482/141 |
| 6,003,470 | A * | 12/1999 | Budman | 119/711 |
| 6,422,983 | B1 | 7/2002 | Weck | |
| 6,554,753 | B1 | 4/2003 | Weck et al. | |
| D497,396 | S * | 10/2004 | Wechsler | D21/398 |
| D507,026 | S * | 7/2005 | Chen | D21/671 |
| D517,136 | S * | 3/2006 | Chen | D21/688 |
| 7,044,820 | B2 * | 5/2006 | Ladisa | 441/81 |
| D545,509 | S * | 6/2007 | Wang | D30/160 |
| 7,244,220 | B2 * | 7/2007 | Carney | 482/106 |
| D564,604 | S * | 3/2008 | Mikail | D21/688 |
| 7,344,488 | B2 | 3/2008 | Weck et al. | |
| 7,563,216 | B1 * | 7/2009 | Kest | 482/141 |
| 7,658,700 | B2 * | 2/2010 | Maloy et al. | 482/132 |
| D612,896 | S * | 3/2010 | Talley | D21/686 |
| 2003/0130096 | A1 * | 7/2003 | LaCroce | 482/106 |
| 2005/0148448 | A1 * | 7/2005 | Mersch | 482/141 |
| 2007/0225133 | A1 * | 9/2007 | Castro | 482/140 |
| 2007/0287600 | A1 * | 12/2007 | Prenatt | 482/41 |

FOREIGN PATENT DOCUMENTS

| | | | |
|---|---|---|---|
| JP | 08000165 | A * | 1/1996 |
| WO | WO 2006115822 | A2 * | 11/2006 |

* cited by examiner

*Primary Examiner* — Loan Thanh
*Assistant Examiner* — Victor K Hwang
(74) *Attorney, Agent, or Firm* — Julio M. Loza; Loza & Loza, LLP

(57) ABSTRACT

Embodiments of the invention are directed to a multi-purpose exercise training tool and methods of use thereof. In one embodiment, the multi-purpose exercise training tool includes a planar bottom face and a contoured top face and is approximately elliptical-shaped or circular-shaped. The multi-purpose exercise training tool may include one or more sets of grip portions allowing a user to grip the multi-purpose exercise training tool at different arm width distances allowing the user to target different muscle groups during use. The training tool is made of a hard, durable material and can be manufactured in a variety of weights.

16 Claims, 6 Drawing Sheets

EXERCISE TRAINING TOOL

CLAIM OF PRIORITY

This application claims the benefit of U.S. Provisional Ser. Nos. 61/098,192 filed Sep. 18, 2008 and 61/098,330 filed Sep. 19, 2008 and hereby incorporated by reference.

FIELD OF THE INVENTION

At least one feature pertains to a multi-purpose exercise training tool and methods of use thereof.

BACKGROUND OF THE INVENTION

Many devices are known for facilitating exercises for therapy, conditioning or physical training. Other than variable resistance training equipment, these devices have not usually offered much adjustability to allow for exercises at different degrees of difficulty. Also, many of these devices have been dedicated to very specific exercises and therefore do not justify a significant investment of space and financial resources for such a narrow purpose.

One such device is an inflatable exercise ball. Generally, the exercise ball is from about fifty-five (55) centimeters to about seventy-five (75) centimeters in diameters and is inflatable with an air pump. Exercises appropriate with an exercise ball are generally limited to abdominal exercises. Moreover, the size of the exercise ball is largely unwieldy making home or gym storage cumbersome.

Another such device is an inflatable exercise half-ball. The exercise half-ball generally has a substantially flat surface for resting on a flat surface (e.g., a floor surface) and a concave surface principally for abdominal exercises Like the exercise ball, the exercise half-ball is from about fifty-five (55) centimeters to about seventy-five (75) centimeters in diameters and is inflatable with an air pump. Exercises appropriate with an exercise ball are generally limited to abdominal exercises. Moreover, the size of the exercise half-ball can be unwieldy.

Consequently, a multi-purpose exercise training tool which is compact and can be used for a variety of different exercises is needed.

SUMMARY OF THE INVENTION

A multi-purpose exercise training tool, comprising: (a) a body having a first face and a second face, the first face planar on an outer surface, the top face rounded on an outer surface, the body having one of an elliptical or circular shape; (b) a first set of grip portions equidistant from one another relative to an axis bisecting a middle of the body wherein the grip portions may be contoured and adapted to allow a user to grip the grip portions; and (c) a first set of openings adjacent the first set of grip portions wherein the openings may be sized to allow a hand of a user to at least partially pass therethrough is herein disclosed.

The multi-purpose exercise training tool may further comprise (d) a second set of grip portions equidistant from one another relative to the axis bisecting the body wherein the grip portions may be contoured and adapted to allow a user to grip the grip portions; and (e) a second set of openings adjacent the second set of grip portions wherein the openings may be sized to allow a hand of a user to at least partially pass therethrough. The second set of grip portions may be closer to the axis relative to the first set of grip portions. The first set of grip portions may be approximately adjacent a horizontal plane bisecting a middle of the body. The second set of grip portions may be approximately adjacent the first face. The first face includes a contoured upper flange and a contoured lower flange. The multi-purpose exercise training tool may further comprise a first sidewall extending from an edge of the contoured upper flange to an edge of a contoured upper edge of the second face. The multi-purpose exercise training tool may further comprise a second sidewall extending from an edge of the contoured lower flange to an edge of a contoured lower edge of the second face. The first sidewall may be contoured and the second sidewall may be contoured. The second face and the first face may be approximately hourglass-shaped, the bottom face smaller relative to the second face.

A multi-purpose exercise training tool, comprising: (a) a body having one of an elliptical or circular shape, the body comprising: (i) a first piece defined by two equal and opposite concave edges and two equal and opposite convex edges, the first piece having a contoured upper flange and a contoured lower flange, the first piece flat on at least one surface; (ii) a second piece defined by two equal and opposite concave edges and two equal and opposite convex edges, the second piece contoured in a downward direction relative to the first piece; (iii) a middle piece between the first piece and the second piece wherein the second piece is fitted on the middle piece and the first piece is fitted within a recess of the middle piece opposite to the second piece; (b) a first set of grip portions equidistant from one another relative to an axis bisecting a middle of the body, each grip portion connected to a set of flanges on the middle piece wherein the grip portions may be contoured and define the body together with a periphery of the middle piece; and (c) a first set of openings adjacent the first set of grip portions wherein the openings may be sized to allow a hand of a user to at least partially pass therethrough is herein disclosed The multi-purpose exercise training tool may further comprise (d) a second set of grip portions equidistant from one another relative to the axis bisecting the body, each grip portion connected to an end of the contoured upper flange and an end of the contoured lower flange wherein the grip portions may be contoured and adapted to allow a user to grip the grip portions; and (d) a second set of openings adjacent the second set of grip portions wherein the openings may be sized to allow a hand of a user to at least partially pass therethrough. The second set of grip portions may be closer to the axis relative to the first set of grip portions. The first set of grip portions may be approximately adjacent a horizontal plane bisecting a middle of the body. The second set of grip portions may be approximately adjacent the bottom piece. The diameter is between 10 inches and 14 inches. The weight is between 2 and 14 pounds.

A multi-purpose exercise training tool, comprising: (a) a body; (b) a first set of grip portions equidistant from one another relative to an axis bisecting a middle of the body wherein the grip portions may be contoured and adapted to allow a user to grip the grip portions; (c) a first set of openings adjacent the first set of grip portions wherein the openings may be sized to allow a hand of a user to at least partially pass therethrough; (d) a second set of grip portions equidistant from one another relative to the axis bisecting the body wherein the grip portions may be contoured and adapted to allow a user to grip the grip portions; and (e) a second set of openings adjacent the second set of grip portions wherein the openings may be sized to allow a hand of a user to at least partially pass therethrough is herein disclosed. The second set of grip portions may be closer to the axis relative to the first set of grip portions.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention.

Embodiments of the invention are directed to a multi-purpose exercise training tool and methods of use thereof. In one embodiment, the multi-purpose exercise training tool includes a planar bottom face and a contoured top face and is approximately elliptical-shaped or circular-shaped. The multi-purpose exercise training tool may include one or more sets of grip portions allowing a user to grip the multi-purpose exercise training tool at different arm width distances allowing the user to target different muscle groups during use. The training tool is made of a hard, durable material and can be manufactured in a variety of weights.

Figure 1A:
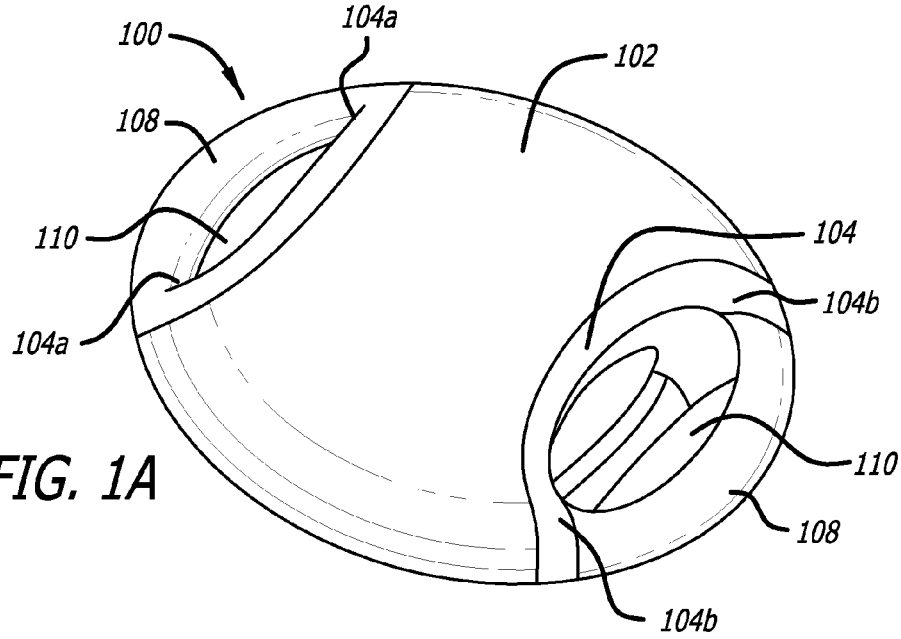
FIG. 1A illustrates a top perspective view of a multi-purpose exercise training tool, equipment, or device according to an embodiment of the invention.

FIG. 1A illustrates a top perspective view of a multi-purpose exercise training tool, equipment, or device 100 according to an embodiment of the invention. The training tool 100 may be made of hard, durable materials such as plastic, rubber, a combination thereof or any other material with similar characteristics. In any case, the material should preferably be resistant to bacterial build-up. In some embodiments, the training tool 100 may be a unitary body or, alternatively, the training tool 100 may be made up of a plurality of components. In some embodiments, the training tool 100 may have at least one component that is filled with a filler material (e.g., sand, plastic pellets, etc.). In some embodiments, training tool 100 is between about eight (8) inches and about twenty-four (24) inches across the major axis.

The training tool 100 may be manufactured in a variety of weights, including, but not limited to, two (2) pounds, four (4) pounds, six (6) pounds, eight (8) pounds, ten (10) pounds, twelve (12) pounds, fourteen (14) pounds and up to one-hundred (100) pounds. The appropriate weight may be selected by the user and should be appropriate to his or her exercise capacity. Additionally, in some embodiments, the training tool 100 may be modified by a user to a desired weight, e.g., using a filler material such as sand, water, weight pellets, etc. In some embodiments, a surface or surfaces may be textured. This feature may provide resistance when gripped or used by a user during exercise.

According to the embodiment shown in FIG. 1A, the training tool 100 is approximately elliptical in shape; however, it should be appreciated that other suitable geometric configurations are within the scope of the invention. According to one embodiment, the training tool 100 may include a top component 102 (or second face or second piece, hereinafter used interchangeably), a middle component 104 (or middle piece, hereinafter used interchangeably) and a bottom component 106 (not shown, see FIG. 1B). Each component 102, 104 and 106 may be approximately defined by two equal and opposite concave edges and two equal and opposite convex edges, each component 102, 104 and 106 sized slightly different relative to one another. The top component 102 may be comprised of one or more pieces and may be approximately contoured (similar to a shell) in a downward direction relative to the bottom component 106. The top component 102 may be attached to the middle component 104 by any permanent or reversible means, such as snap-locks, press-fitting or thermoplastic welding. The top component 102 may completely or substantially cover a top surface of the middle component 104. It should be appreciated that the device as shown and described can be positioned on its top face 102 or its bottom face 106 relative to a flat surface depending on the type of exercise desired. In that regard, the device 100 does not have a true "top" or "bottom" and it should be appreciated that the terms "top" and "bottom" are used for ease of description only.

In the embodiment in which the training tool 100 is elliptical in shape, the training tool 100 may be symmetric about its center defined by the major axis (transverse) and the minor axis (conjugate) bisecting therethrough. Equidistant from the major axis left-side antipodal point may be two protrusions 104*a* integral with the middle component 104. Similarly, equidistant from the major axis right-side antipodal point may be two protrusions 104*b* integral with the middle component 104. According to one embodiment, a first set of contoured grip portions 108 may connect to the protrusions 104*a* and 104*b*, respectively. That is, each first grip portion 108 may be equidistant from one another relative to the major axis, or one-hundred and eighty (180) degrees apart from one another. The protrusions 104*a*, 104*b* may connect with the grip portions 108 by any permanent or reversible means, such as snap-locks, press-fitting or thermoplastic welding. According to some embodiments, the first set of grip portions 108 are approximately adjacent a horizontal plane bisecting the middle component 104 (see FIG. 3E). That is, when a user places the training tool 100 with either the top component 102 or the bottom component 106 facing the ground, the grip portions 108 do not make contact with the flat surface. In this manner, a user is able to grip the grip portions 108 for use during various exercises without his/her knuckles contacting the ground. In an alternative embodiment, the grip portions 108 may be "hourglass-shaped" or any other suitable configuration.

Generally, the combination of an outer periphery (i.e., equal and opposite convex edges) of the middle component 104 and an outer periphery of the first set of grip portions 108 connected to the middle component 104 approximately define the elliptical shape of the training tool 100. Additionally, the combination of an inner periphery of the middle component 104 (equal and opposite concave edges) and an inner periphery of the first set of grip portions 108 connected to the middle component 104 define openings 110. The openings 110 may be sufficiently large to accommodate a human hand traversing therethrough, e.g., approximately six (6) inches long and one (1) inch wide. In any case, openings 110 should be sized to allow a portion of a hand of the user to pass through and grip contoured grip portion 108.

Figure 1B:
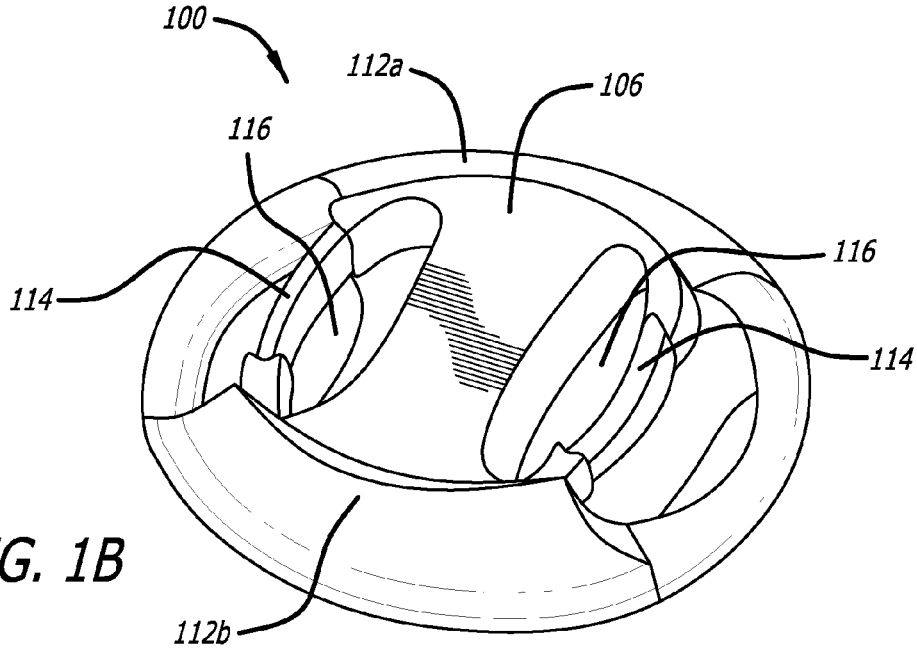
FIG. 1B illustrates a bottom perspective view of the multi-purpose exercise training tool of FIG. 1A.

FIG. 1B illustrates a bottom perspective view of a multi-purpose exercise training tool 100 of FIG. 1A. In this view, the bottom component 106 is shown in more detail. The bottom component 106 may be defined by two equal and opposite concave edges and two equal and opposite convex edges and flat on its outer surface. In one embodiment, the bottom component 106 may have a contoured upper flange 112*a* and a contoured lower flange 112*b*. Each end of the flanges 112*a*, 112*b* may connect to a second set of contoured grip portions 114. That is, each grip portion 114 may be equidistant from one another relative to the major axis, or one-hundred and eighty (180) degrees apart from one another. The ends of the flanges 112*a*, 112*b* may connect with the grip portions 114 by any permanent or reversible means, such as snap-locks, press-fitting or thermoplastic welding. As shown, the first set of grip portions 114 are closer to the major axis relative to the first set of grip portions 108 and are approximately adjacent to, or slightly recessed relative to, the outer surface of the bottom component 106. In one embodiment, the first set of grip portions 108 are larger relative to the second set of grip portions 114.

The combination of an inner periphery of the bottom component 106 (equal and opposite convex edges) and an inner periphery of the second set of grip portions 114 connected to the flanges 112*a*, 112*b* define openings 116. Openings 116 may be sufficiently large to accommodate a human hand, e.g., approximately six (6) inches long and one (1) inch wide. In any case, openings 116 should be sized to allow a portion of a hand of the user to pass through and grip contoured grip portion 114. It should be appreciated that the top component 102, the bottom component 106 or both the top and bottom components 102, 106 have a soft surface such as one made from felt or a gel-like plastic.

Figure 1C:
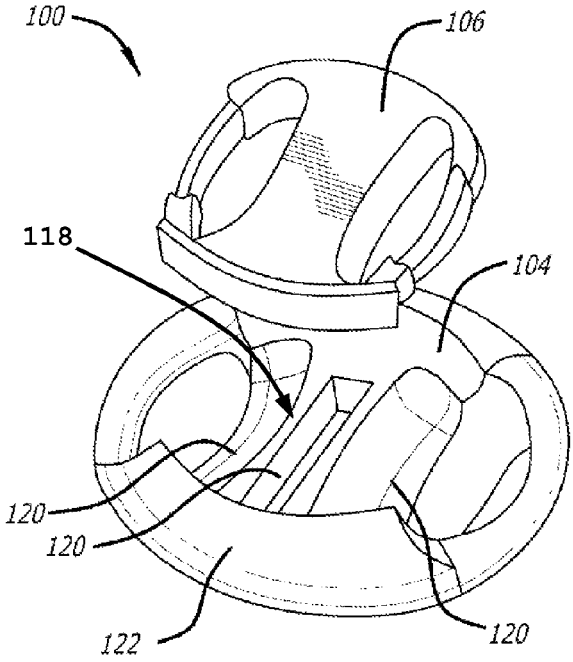
FIG. 1C illustrates an exploded perspective view of a middle component and a bottom component of the multi-purpose exercise training tool of FIG. 1A

FIG. 1C illustrates an exploded perspective view of the middle component 104 and the bottom component 106. As shown, the middle component 104 may have a recessed portion 118 for receiving the bottom component 106. One or more grooves 120 may transverse the recessed portion 118 along the minor axis. For example, two outer grooves 120 may approximately align with the openings 116 when the bottom component 106 is fitted within the recess portion 118 of the middle component 104. This provides additional space for the user's hand when gripping the grip portions 114 when the user is performing various exercises using the device 100. A middle groove 120 may receive a flange (not shown) on a lower surface of the bottom component 106 when fitted to the middle component 104. The bottom component 106 may be attached to the middle component 104 by any permanent or reversible means, such as snap-locks, press-fitting or thermoplastic welding. The middle component 104 may have contoured sidewalls 122 extending from a periphery of a bottom face to a periphery of a top face of the middle component 104.

Figure 2A:
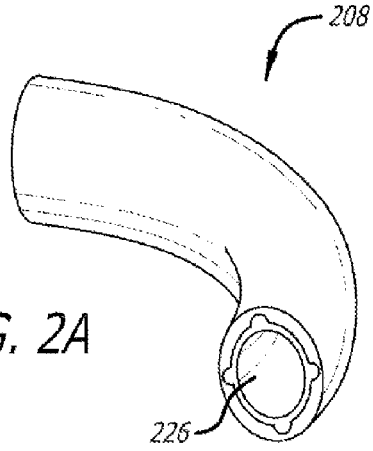
FIG. 2A illustrates a perspective view of a grip portion according to an embodiment of the invention.

FIG. 2A illustrates a perspective view of a cross-section of a grip portion according to an embodiment of the invention. The grip portion 208 may be contoured and tubular in shape. Ends of the grip portion 208 may terminate in openings 226 (only one illustrated in this view) defined by the inner surface of the grip portion 208, i.e., the inner surface may define a contoured lumen. The openings 226 may fit to protrusions or flange ends of a bottom component or a middle component of a device according to embodiments previously described. It should be noted that the grip portion as illustrated may be illustrative of the first grip portion and/or the second grip portion.

Figure 2B:
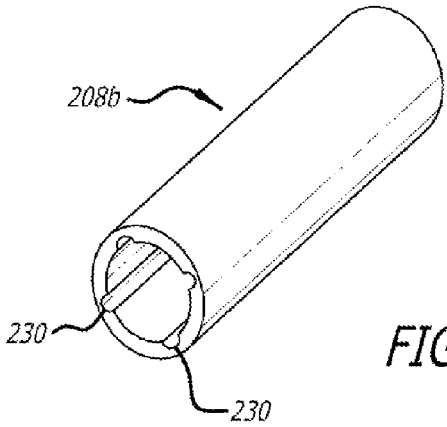
FIG. 2B illustrates an exploded view of the grip portion of FIG. 2A.
Figure 2B:
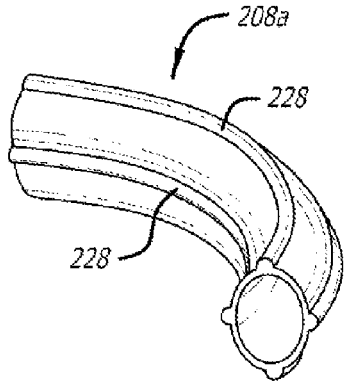

FIG. 2B illustrates an exploded view of the grip portion of FIG. 2A. The grip portion 208 may include a fixed-shape inner portion 208*a* and a flexible outer portion 208*b*. The inner portion 208*a* provides rigidity while the outer portion provides a non-slip surface for when a user grips the grip portion 208. The outer portion 208*b* may slidably engage about the inner portion 208*a*. Ridges or flanges 228 about the inner portion 208*a* may fit within grooves 230 within the outer portion 208*b* to substantially or completely reduce slippage when gripped by a user.

Figure 3A:
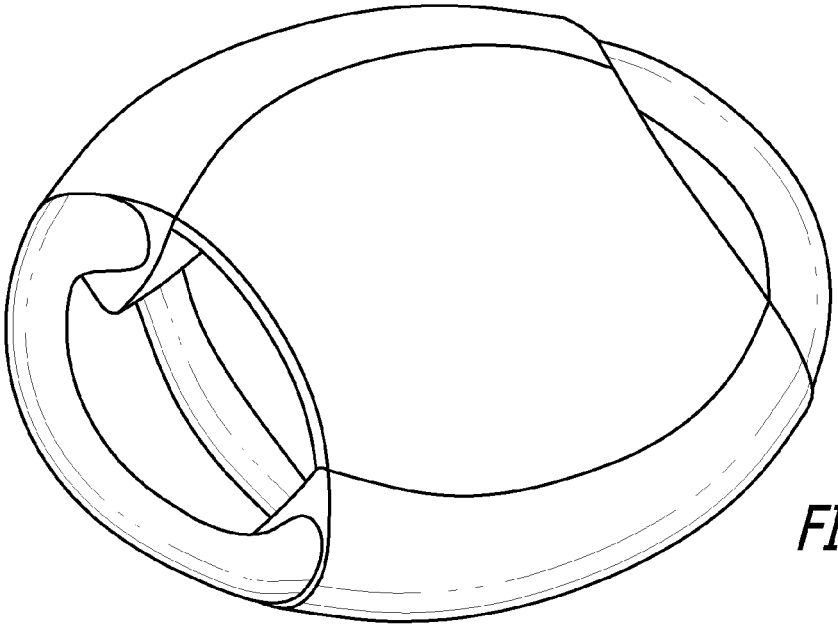
FIG. 3A illustrates a top perspective view of a multi-purpose exercise training tool, equipment, or device according to an alternative embodiment of the invention.

FIG. 3A illustrates a top perspective view of a multi-purpose exercise training tool, equipment, or device according to an alternative embodiment of the invention.

Figure 3B:
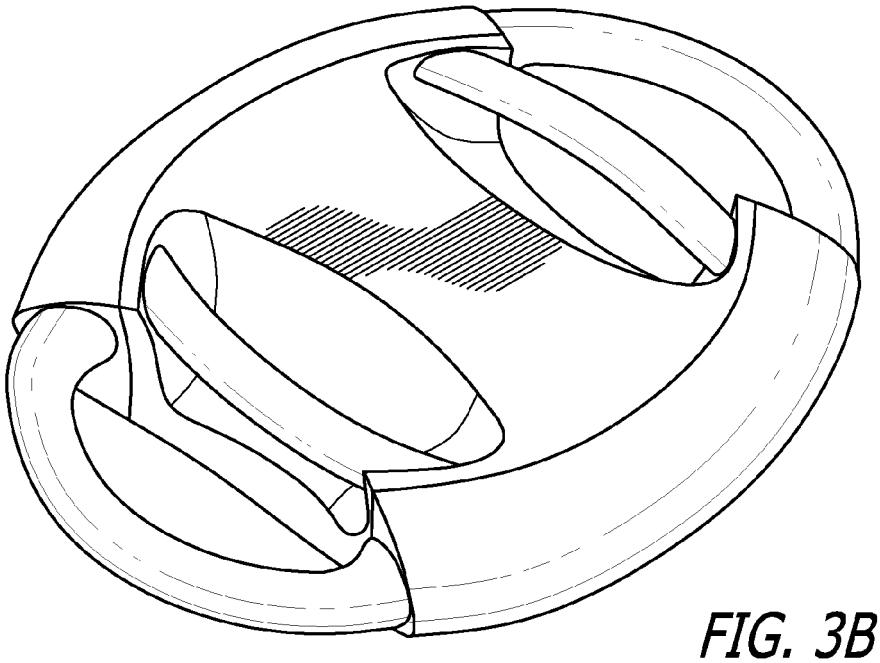
FIG. 3B illustrates a bottom perspective view of the multi-purpose exercise training tool of FIG. 3A.

FIG. 3B illustrates a bottom perspective view of the multi-purpose exercise training tool of FIG. 3A.

Figure 3C:
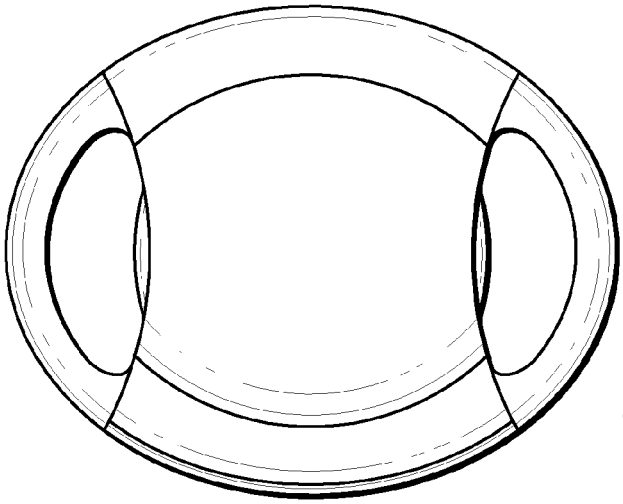
FIG. 3C illustrates a top view of the multi-purpose exercise training tool of FIG. 3A.

FIG. 3C illustrates a top view of the multi-purpose exercise training tool of FIG. 3A.

Figure 3D:
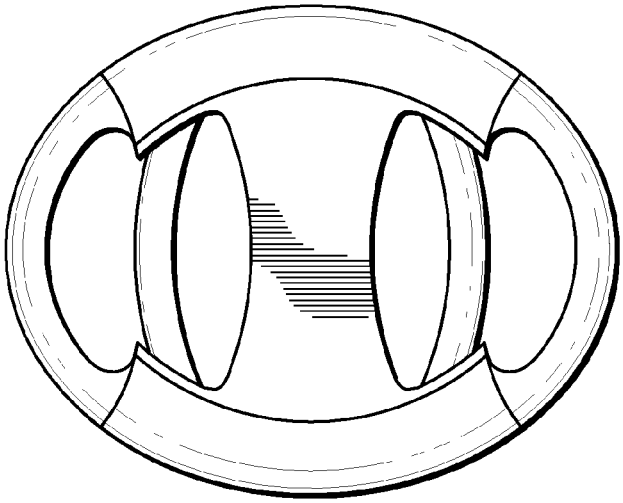
FIG. 3D illustrates a bottom view of the multi-purpose exercise training tool of FIG. 3A.

FIG. 3D illustrates a bottom view of the multi-purpose exercise training tool of FIG. 3A.

Figure 3E:
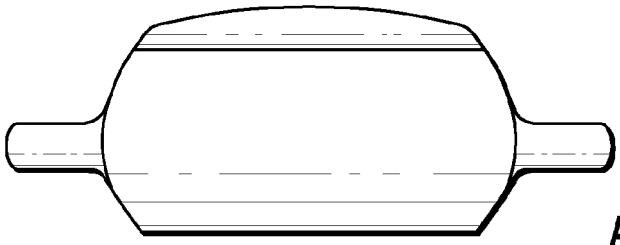
FIG. 3E illustrates a side view of the multi-purpose exercise training tool of FIG. 3A.
Figure 4A:
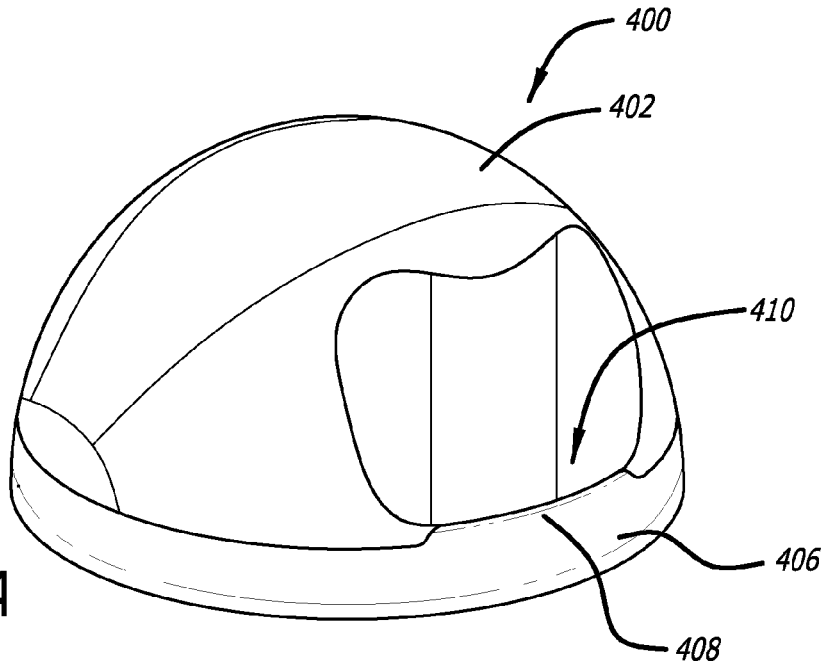
FIGS. 4A-4D illustrate a multi-purpose exercise training tool, equipment, or device according to an alternative embodiment of the invention.
Figure 4B:
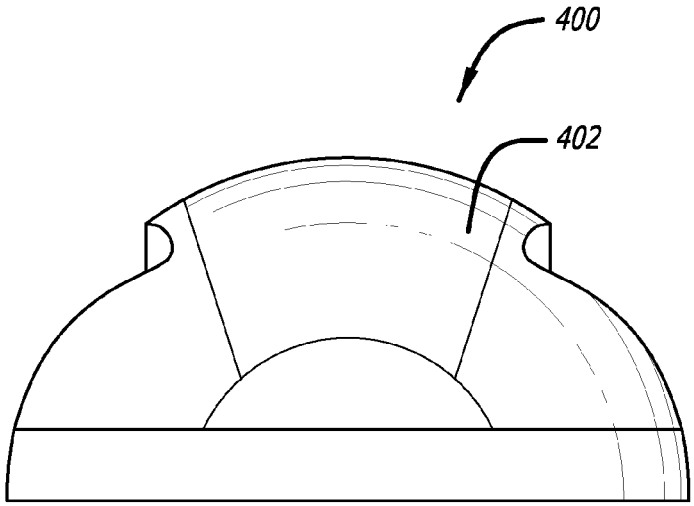
Figure 4C:
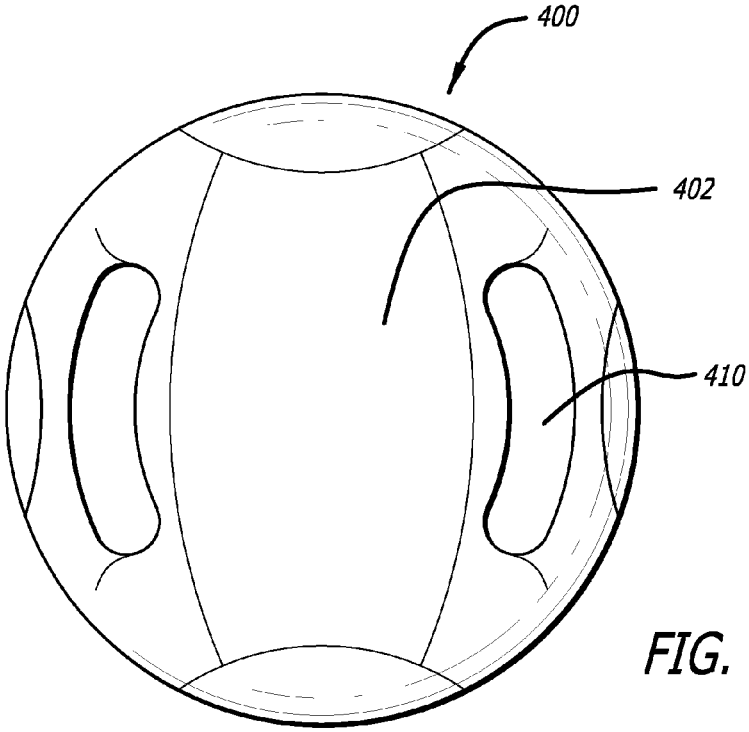
Figure 4D:
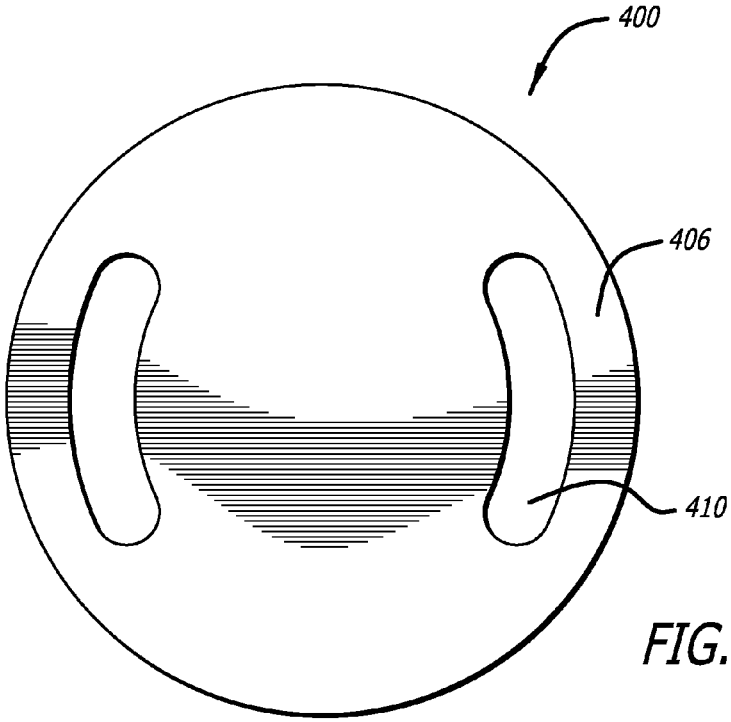

FIG. 3E illustrates a side view of the multi-purpose exercise training tool of FIG. 3A.

FIGS. 4A-4D illustrate an alternative embodiment of a training tool or device. In this alternative embodiment, a multi-purpose training tool 400 is approximately hemispherical in shape; however, other geometric configurations are within the scope of the invention. In the alternative embodiment, openings 410 may continue through the training tool 400 from a flat face 406 to a surface portion of a hemispherical face 402 adjacent to an apex of the training tool 400. As a result, such configuration provides an inner sidewall adjacent the openings which may provide an additional grip surface for the user. The grip portions 408 are contoured and adapted to allow a user to grip the grip portion 408. In one embodiment, each contoured grip portion 408 is approximately hour-glass shaped; however, other shapes are within the scope of the invention. In one embodiment, openings 410 (when viewed from flat face) are approximately concave in shape relative to the outer diameter of training tool 400; however, other shapes are within the scope of the invention.

In an alternative embodiment, the training tool may include one grip portion and an opening or a plurality of grip portions and/or openings of various sizes. For example, one grip portion may be on the apex of the hemispherical face; two equidistant grip portions (relative to an axis bisecting the device) may be at any suitable location of the device. Additionally, the overall shape of the training tool may be elliptical, rectangular, square, triangular, and/or other shapes without deviating from the present invention.

Advantageously, the training tool is compact and has grip portions so that a user can easily maneuver training tool to carry out a wide variety of exercises. The configuration of training tool allows for more stability and a fuller range of motion compared to other prior art exercise training tools. More particularly, training tool 100 or 400 allows the user to effectuate a full body workout. Examples of exercises which may be performed by a user using training tool include, but are not limited to, the bilateral or unilateral press, the bilateral or unilateral fly, the bilateral or unilateral push-up, the serratus anterior push-up, the elbows-in push-up, the bilateral or unilateral straight arm pullover, the unilateral or bilateral row elbows (in or out), "good mornings", bicep or bicep concentration curls, bilateral or unilateral hammer curls, bilateral or unilateral tricep extensions, tricep kickbacks, the unilateral or bilateral shoulder shrug, bilateral or unilateral front lifts, bilateral or unilateral side lifts (raises), the reverse fly, squats, lunges, stiff-legged dead lift, sit-ups, crunches, lifts, or oblique twists. Embodiments of the device allow for increased range of motion and varying degrees of stability. For example, the flat surface deals with range of motion while the rounded surface, the flat surface, as well as the second set of grip portions, allow for increased/decreased stability depending on the exercises being done.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A multi-purpose exercise training tool, comprising:

a body having a first face and a second face, the first face planar on an outer surface, the second face rounded on an outer surface, the body having one of an elliptical or circular shape;

a first set of grip portions equidistant from one another relative to an axis bisecting a middle of the body wherein the grip portions are contoured and adapted to allow a user to grip the grip portions wherein edges of the second face are integrally continuous with edges of the first set of grip portions to define the elliptical or circular body;

a first set of openings adjacent the first set of grip portions wherein the openings are sized to allow a hand of a user to at least partially pass therethrough;

a second set of grip portions equidistant from one another relative to the axis bisecting the body wherein the grip portions are contoured and adapted to allow a user to grip the grip portions; and a second set of openings adjacent the second set of grip portions wherein the openings are sized to allow a hand of a user to at least partially pass therethrough.

2. The multi-purpose exercise training tool of claim 1 wherein the second set of grip portions are closer to the axis relative to the first set of grip portions.

3. The multi-purpose exercise training tool of claim 1 wherein the first set of grip portions are approximately adjacent a horizontal plane bisecting a middle of the body.

4. The multi-purpose exercise training tool of claim 1 wherein the second set of grip portions are approximately adjacent the first face.

5. The multi-purpose exercise training tool of claim 1 wherein the first face includes a contoured upper flange and a contoured lower flange.

6. The multi-purpose exercise training tool of claim 5, further comprising:

a first sidewall extending from an edge of the contoured upper flange to an edge of a contoured upper edge of the second face.

7. The multi-purpose exercise training tool of claim 6, further comprising:

a second sidewall extending from an edge of the contoured lower flange to an edge of a contoured lower edge of the second face.

8. The multi-purpose exercise training tool of claim 7 wherein the second sidewall is contoured.

9. The multi-purpose exercise training tool of claim 6 wherein the first sidewall is contoured.

10. The multi-purpose exercise training tool of claim 1 wherein the second face and the first face are approximately hourglass-shaped, the second face smaller relative to the first face.

11. A multi-purpose exercise training tool, comprising:

a body having one of an elliptical or circular shape, the body comprising:

a first piece defined by two equal and opposite concave edges and two equal and opposite convex edges, the first piece having a convex upper flange adjacent one convex edge and a convex lower flange adjacent the other convex edge, the first piece flat on at least one surface;

a second piece defined by two equal and opposite concave edges and two equal and opposite convex edges, the second piece contoured in a downward direction relative to the first piece when coupled thereto;

a middle piece between the first piece and the second piece wherein the second piece is fitted on the middle piece and the first piece is fitted within a recess of the middle piece opposite to the second piece;

a first set of grip portions equidistant from one another relative to an axis bisecting a middle of the body, each grip portion connected to a set of flanges on the middle piece wherein the grip portions are contoured and define the body together with a periphery of the middle piece;

a first set of openings adjacent the first set of grip portions wherein the openings are sized to allow a hand of a user to at least partially pass therethrough;

a second set of grip portions equidistant from one another relative to the axis bisecting the body, each grip portion connected to an end of the convex upper flange and an end of the convex lower flange wherein the grip portions are contoured and adapted to allow a user to grip the grip portions; and a second set of openings adjacent the second set of grip portions wherein the openings are sized to allow a hand of a user to at least partially pass therethrough.

12. The multi-purpose exercise training tool of claim 11 wherein the second set of grip portions are closer to the axis relative to the first set of grip portions.

13. The multi-purpose exercise training tool of claim 11 wherein the first set of grip portions are approximately adjacent a horizontal plane bisecting a middle of the body.

14. The multi-purpose exercise training tool of claim 11 wherein the second set of grip portions are approximately adjacent the first piece.

15. The multi-purpose exercise training tool of claim 11 wherein a diameter of the tool is between 10 inches and 14 inches.

16. The multi-purpose exercise training tool of claim 11 wherein a weight of the tool is between 2 and 14 pounds.

* * * * *